US010805751B1

(12) United States Patent
Liang

(10) Patent No.: US 10,805,751 B1
(45) Date of Patent: Oct. 13, 2020

(54) SOUND PRODUCING DEVICE

(71) Applicant: xMEMS Labs, Inc., Los Altos, CA (US)

(72) Inventor: Jemm Yue Liang, Sunnyvale, CA (US)

(73) Assignee: xMEMS Labs, Inc., Santa Clara, CA (US)

( * ) Notice: Subject to any disclaimer, the term of this patent is extended or adjusted under 35 U.S.C. 154(b) by 0 days.

(21) Appl. No.: 16/695,199

(22) Filed: Nov. 26, 2019

Related U.S. Application Data

(60) Provisional application No. 62/897,365, filed on Sep. 8, 2019.

(51) Int. Cl.

| | |
|---|---|
| ***H04R 29/00*** | (2006.01) |
| ***H04R 3/00*** | (2006.01) |
| ***H04R 17/00*** | (2006.01) |
| ***H04R 19/02*** | (2006.01) |

(52) U.S. Cl.
CPC ..... *H04R 29/001* (2013.01); *H04R 3/00* (2013.01); *H04R 17/00* (2013.01); *H04R 19/02* (2013.01)

(58) Field of Classification Search
CPC .. H04R 29/001; H04R 3/00; H04R 2201/003; H04R 3/002; H04R 3/007; H04R 3/04; H04R 17/00; H04R 29/00; H04R 29/003; H04R 19/005; H04R 1/02
USPC ..... 381/59, 1, 103, 27, 98, 104
See application file for complete search history.

(56) References Cited

U.S. PATENT DOCUMENTS

2007/0030983 A1* 2/2007 Aarts ..... H04R 3/04 381/97
2009/0279716 A1* 11/2009 Stahl ..... B06B 1/18 381/111
2012/0018244 A1* 1/2012 Robert ..... B06B 1/0292 181/142
2013/0044904 A1* 2/2013 Margalit ..... H04R 17/00 381/182
2013/0121509 A1* 5/2013 Hsu ..... H04R 19/005 381/104
2013/0255376 A1* 10/2013 Han ..... G01C 19/56 73/504.12
2014/0157902 A1* 6/2014 Sugiura ..... B06B 1/0666 73/627
2014/0341394 A1* 11/2014 Croft, III ..... H04R 1/2811 381/102
2015/0124982 A1* 5/2015 Berthelsen ..... H04R 29/001 381/59
2016/0183002 A1* 6/2016 Vinayak ..... H04R 3/002 381/59
2017/0223468 A1 8/2017 Jensen
2018/0234783 A1 8/2018 Clerici

FOREIGN PATENT DOCUMENTS

WO 2016/107975 A1 7/2016

* cited by examiner

*Primary Examiner* — Fan S Tsang
*Assistant Examiner* — Julie X Dang
(74) *Attorney, Agent, or Firm* — Winston Hsu

(57) ABSTRACT

A sound producing device (SPD) is provided. The SPD comprises a membrane, having a resonance frequency and a resonance bandwidth; and an actuator, disposed on the membrane, receiving a driving signal corresponding to an input audio signal; wherein the input audio signal has an input audio band which is upper bounded by a maximum frequency; wherein the resonance frequency is higher than the maximum frequency plus a half of the resonance bandwidth.

11 Claims, 6 Drawing Sheets

SOUND PRODUCING DEVICE

CROSS REFERENCE TO RELATED APPLICATIONS

This application claims the benefit of U.S. provisional application No. 62/897,365, filed on Sep. 8, 2019, which is incorporated herein by reference.

BACKGROUND OF THE INVENTION

1. Field of the Invention

The present application relates to a sound producing device, and more particularly, to a sound producing device capable of enhancing sound quality.

2. Description of the Prior Art

Magnet and Moving coil (MMC) based sound producing devices (SPD), including balance-armature speaker drivers, have been developed for decades and many modern devices still depend on them to generate sound.

MMC is ill fitted as a truly broad band sound source due to various resonance frequencies of the device which falls within the audible band. For example, the resonance associated with the membrane and its support, resonance associated with the electrical inductance (L) of the moving coil and the mechanical capacitance C of the membrane support, the mechanical resonance arise from the spring of air within back enclosure and the mass of the membrane, the ringing of the membrane surface, or, in the case of balance armature (BA) speakers, the triple resonance of the front chamber, back camber and the port tube, etc., would fall within the audible band. In the design of MMC, some of such resonances are viewed upon as desirable features, and smart arrangements were made to utilize such resonance to increase the displacement of the membrane and therefore generating higher SPL.

Recently, MEMS (Micro Electro Mechanical System) microspeakers become another breed of sound producing devices (SPD) which make use of thin film piezoelectric material as actuator, thin single crystal silicon layer as membrane and make use of semiconductor fabrication process. Despite the material and manufacturing process, the age-old MMC design mentality and practices were applied, almost blindly, to MEMS microspeakers, without taking differences between the MMC and MEMS into consideration. Hence, some disadvantages on the MEMS SPD product would be produced.

Therefore, it is necessary to improve the prior art.

SUMMARY OF THE INVENTION

It is therefore a primary objective of the present application to provide a sound producing device capable of enhancing sound quality.

An embodiment of the present application discloses a sound producing device (SPD). The SPD comprises a membrane, having a resonance frequency and a resonance bandwidth; and an actuator, disposed on the membrane, receiving a driving signal corresponding to an input audio signal; wherein the input audio signal has an input audio band which is upper bounded by a maximum frequency; wherein the resonance frequency is higher than the maximum frequency plus a half of the resonance bandwidth.

These and other objectives of the present invention will no doubt become obvious to those of ordinary skill in the art after reading the following detailed description of the preferred embodiment that is illustrated in the various figures and drawings.

DETAILED DESCRIPTION

There are two main differences between the MMC SPD and the MEMS SPD, e.g., piezoelectric actuated MEMS SPD: 1) The characteristic of membranes motion generated during sound production is drastically different, where MMC SPD is force-based but MEMS SPD is position-based; 2) The quality factor (i.e., Q factor, sometimes abbreviated as "Q" in the following description) of MEMS SPD resonance is typically 100±40 which has spiky and narrow peaking frequency response; while the Q factor of MMC resonances are typically in the range of 0.7~2, much smaller than the Q of the MEMS SPD, and therefore has very smooth and broad peaking.

The feasibility for MMC SPD to utilize resonances to produce the desirable frequency response depends a lot on the low Q of such resonance which allows multiple relatively broad-banded smooth peaking to be kneaded together and form a frequency response which is relatively flat between those resonance frequencies.

However, such resonance-kneading is no longer feasible for PAM MEMS SPD because the resonance Q is way too high and the excessive ringing around the resonance frequency will cause: a) severe membrane excursion and induce rather massive nonlinearity, and b) extended ringing after the excitation source has terminated (high Q comes from low dissipation factor, so once the ringing starts, like hitting the edge of the coin, the ringing will sustain for an extended period of time after the impact). The item a causes THD (Total Harmonic Distortion) and IM (Inter-modulation) to rise due to the nonlinearity caused by the excessive membrane excursion, while the item b would cause sound quality to become "colored" and "muddied".

The fundamental idea of the present invention is to move the resonance frequency (or resonant frequency) of the MEMS SPD upward to be above the audio signal band (e.g., beyond 22 KHz), such that barely/no resonance happens in the audio band. Hence, the membrane excursion, the THD and IM, the nonlinearity and the extended ringing can be avoided. In the present application, the terms "resonance frequency" and "resonant frequency" are used interchangeably.

Figure 1:
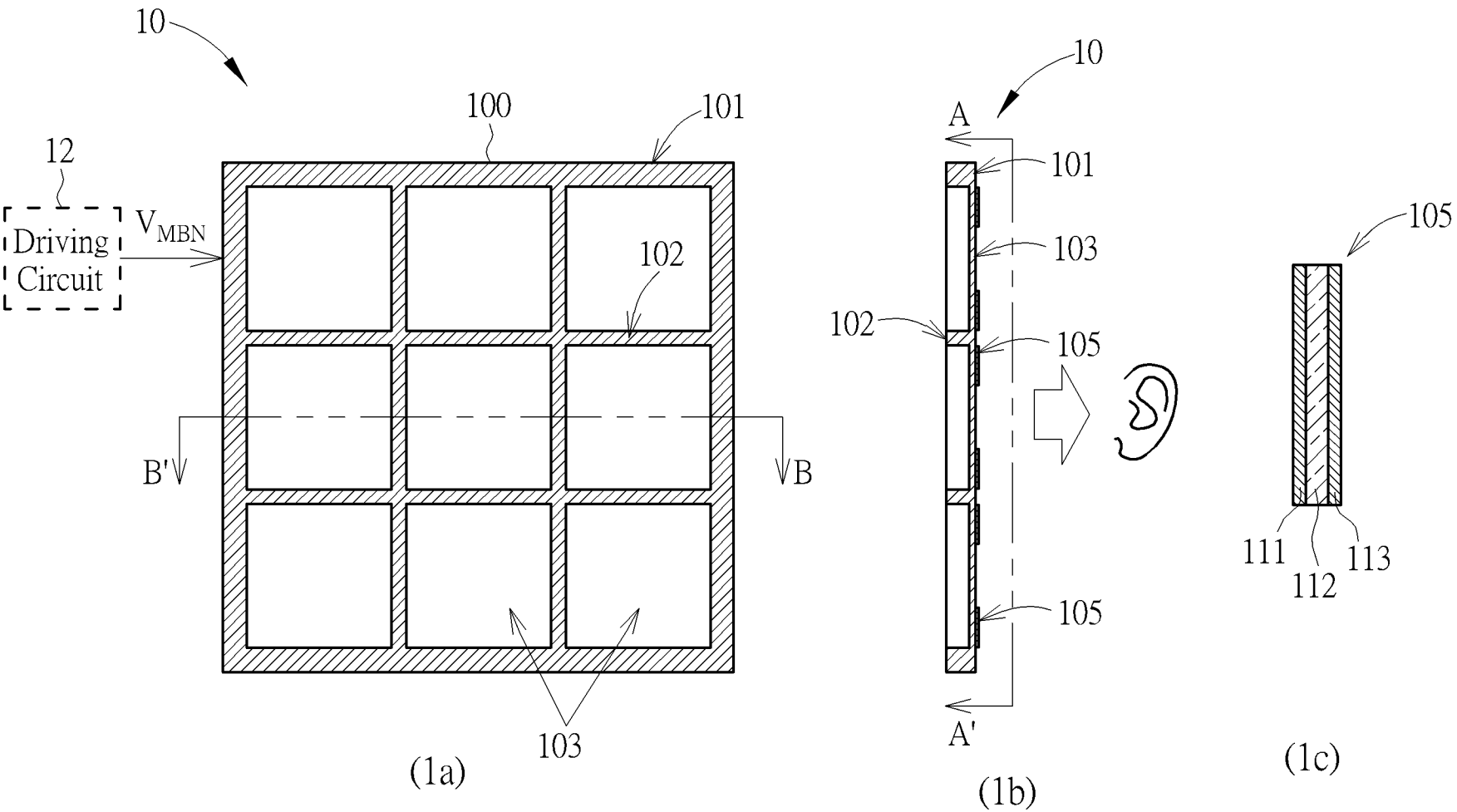
FIG. 1 is a schematic diagram of a sound producing device (SPD) according to an embodiment of the present application.

FIG. 1 is a schematic diagram of a sound producing device (SPD) 10 according to an embodiment of the present application. FIG. 1*a* illustrates a top view (in a perspective of A-A' show in FIG. 1*b*) of the SPD 10. FIG. 1*b* illustrates a cross sectional view in a perspective of B-B' shown in FIG. 1*a*. FIG. 1C is an exploded view of an actuator 105. The SPD 10 may be a MEMS (Micro Electro Mechanical System) microspeaker, which may be applied in an application of an in-ear headset.

The SPD 10 may comprise a cell array 100 comprising a plurality of cells. Each cell comprises a membrane 103 and the actuator 105 attached/disposed on the membranes 103. The membrane 103 may be a single or poly crystal silicon membrane. In the case of single crystal membrane, the membrane may be manufactured by an SOI (Silicon-On-Insulator) manufacturing process. The actuator 105 may be a thin film actuator, e.g., a piezoelectric actuator, which comprises electrodes 111, 113 and a material 112 (e.g. piezoelectric material). A driving signal $V_{MBN}$ is applied across the electrodes 111 and 113 to cause the (piezoelectric) material to deform, such that a displacement $U_z=\Delta P_z$ of the membrane 103 from a time $t_{i-1}$ to a time $t_i$ would be substantially proportional to a voltage difference $\Delta V$ of the driving signal $V_{MBN}$, where $P_z$ denotes a position of membrane 103. For completeness, a device edge 101 and a cell-to-cell wall 102 within the cell array 100 are also illustrated.

The SPD 10 also comprises a driving circuit 12, schematically illustrated in FIG. 1*a*. The driving circuit 12 is configured to generate the driving signal $V_{MBN}$ according to the input/source audio signal AUD. The input/source audio signal AUD has an input audio band which is upper bounded by a maximum frequency $f_{max}$. The maximum frequency $f_{max}$ may be a maximum audible frequency, e.g., 22 KHz, or lower, depending on various applications. For example, the maximum frequency $f_{max}$ of a voice-related application may be 5 KHz, which is significantly lower than 22 KHz the maximum audible frequency.

Figure 2:
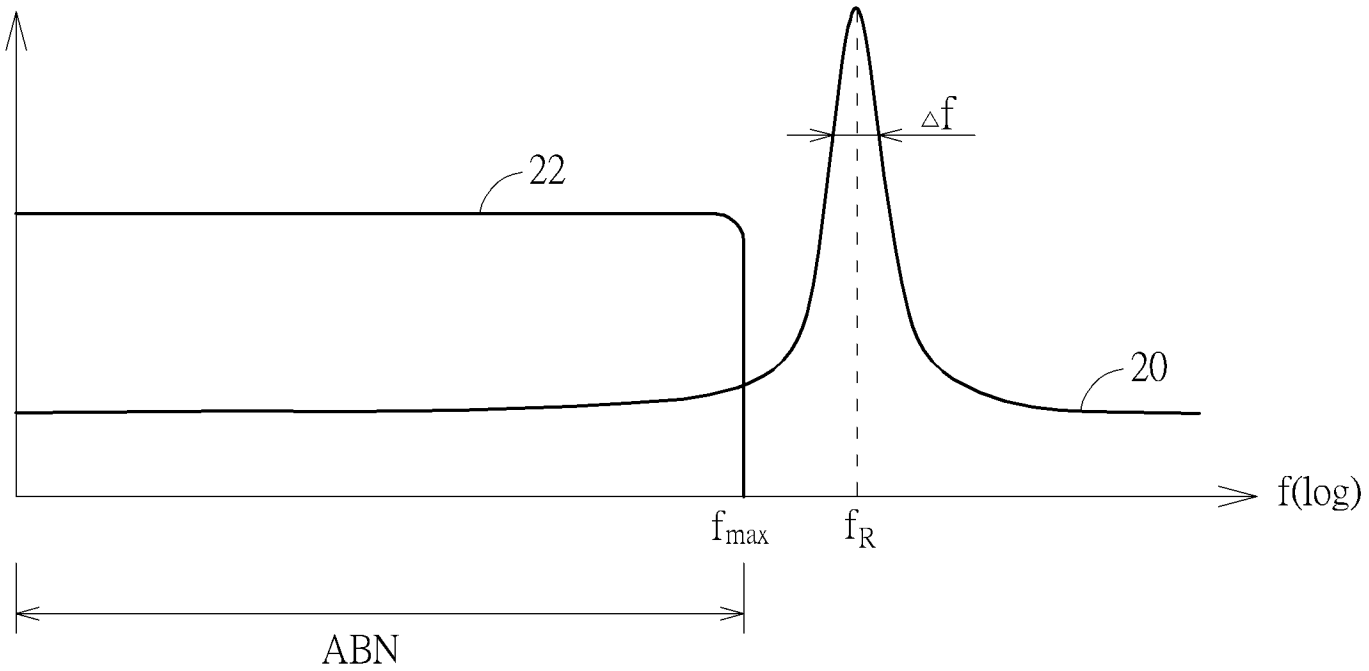
FIG. 2 illustrates a membrane resonance frequency and a maximum frequency.

Different from the MEMS SPD in prior arts, the membrane 103 is designed to have a resonance frequency $f_R$ significantly higher than the maximum frequency $f_{max}$. FIG. 2 illustrates the resonance frequency $f_R$ and the maximum frequency $f_{max}$ according to an embodiment of the present application. In FIG. 2, a curve 20 representing a frequency response of the membrane 103 and a curve 22 representing an input audio band ABN of the input audio signal AUD are also schematically illustrated. The resonance frequency $f_R$ of the membrane 103 should be sufficiently higher than the maximum frequency $f_{max}$, such that resonance of the membrane 103 would barely happen in the audio band ABN.

To avoid the resonance of the membrane 103 falling/happening within the audio band ABN, the membrane resonance frequency $f_R$ of the membrane 103 shall be at least higher than the maximum frequency $f_{max}$ plus a half of a resonance bandwidth $\Delta f$ of the membrane 103, i.e., $f_R>f_{max}+\Delta f/2$, where $\Delta f$ represents a full width at half maximum (FWHM) and $\Delta f/2$ represents a half width at half maximum (HWHM) of the membrane 103. Preferably, the membrane resonance frequency $f_R$ of the membrane 103 may be chosen to yield a rise of 3~10 dB within the audio band ABN to alleviate resonance or even guarantee no resonance within the audio band ABN.

Note that, the Q factor may be defined as $Q=(f_R/\Delta f)$. The Q factor of the membrane 103 may be in a range of 100±40, or be at least 50. In this case, $\Delta f=(f_R/Q)$ would be relatively small compared to the resonance frequency $f_R$ when Q is sufficiently large.

In an embodiment, the membrane resonance frequency $f_R$ may reside at least 10% above the upper limit of input signal frequency (i.e., the maximum frequency $f_{max}$). For example, for the SPD 10 receiving PCM (Pulse-Code Modulation) encoded sources such as CD music or MP3, or wireless channel source such as Bluetooth, the data sample rate is generally 44.1 KHz and, by the Nyquist law, the upper limit of the input signal frequency (i.e., the maximum frequency $f_{max}$) would be approximately 22 KHz. Therefore, the resonance frequency would preferably range between 23 KHz and 27.5 KHz≈25 KHz±10%·22 KHz, which would guarantee the driving signal $V_{MBN}$ of the SPD 10 contains no frequency component near the resonance frequency. Therefore, the membrane excursion and the extended ringing can be avoided, and the sound quality is further enhanced.

Note that, the resonance frequency $f_R$, the resonance bandwidth $\Delta f$ and the Q factor are parameters determined at/before the manufacturing process. Once the SPD 10 is designed and manufactured, those parameters are fixed.

Note that, the SPD of the present application does not have to comprise multiple cells. An SPD comprises single cell with single membrane is sufficient, which is within the scope of the present application.

In the prior art, conventional MEMS SPDs are designed to have the resonance frequency lying within the audio band (i.e., $f_R<f_{max}$), inheriting the design methodology of the MMC SPD, which is to utilize resonances to sustain the desirable frequency response, without considering the high-Q characteristics of MEMS SPD. The conventional MEMS SPD, with the resonance frequency lying within the audio band, suffers from nonlinearity and extended ringing due to the membrane resonance, both of which degrade the sound quality produced. To overcome the disadvantages of the prior art MEMS SPD, the membrane 103 is designed to have high Q-factor and have the resonance frequency $f_R$ significantly higher than the maximum frequency $f_{max}$, e.g., $f_R>f_{max}+\Delta f/2$, which is different from the conventional MEMS SPDs.

Back to item 1 stated in the above, the MMC SPD is "force-based". Specifically, in the MMC SPD, the membrane is moved by the Lorenz force due to the interaction between flux, field of the magnet and the electric current of the moving-coil. Such force causes the membrane to accelerate, which produces pressure gradient. When the current changes, the amount of Lorenz force also changes, and the acceleration of membrane also changes as a result, and such changing acceleration produces changing air pressure on the surface of the membrane, and such changing air pressure will propagate and become acoustic soundwave. That's why the MMC SPD is "force-based".

On the other hand, the piezoelectric actuated MEMS SPD is "position-based" SPD. Specifically, for signal frequency significantly lower than resonance frequency $f_R$ (e.g., for the case that the SPD 10 operates at a frequency $f_o$p lower than $(f_R-\Delta f/2)$, i.e., $f_{OP}<(f_R-\Delta f/2)$), the position of the membrane 103 can be controlled directly by the applied voltage (i.e., $V_{MBN}$). The position of the membrane 103, denoted as $P_Z$, may follow $\Delta P_Z \propto d_{31}\cdot\Delta V$ (eq. 1), where $\Delta V$ denotes a voltage difference of the driving signal $V_{MBN}$ between the times $t_{i-1}$ and $t_i$, $\Delta P_Z$ denotes a position difference corresponding to the time gap between the times $t_{i-1}$ and $t_i$ (where response time of the piezoelectric material is neglected), and $d_{31}$ denotes the piezoelectric actuator's transverse deformation coefficient. It is because that the deformation of the piezoelectric material obeys the formula as $\Delta L=d_{31}\cdot(l/h)\cdot V_{MBN}$, where l and h denote a length and a height of the (piezoelectric) actuator 105, and $\Delta L$ denotes a change in length of the actuator 105. Through the layered actuator/membrane structure, the deformation ΔL of (piezoelectric) actuator 105 causes up and down movement of the membrane 103. In other words, when operating within the linear range of the membrane 103, with the driving signal significantly below the resonance frequency $f_R$, the relationship between the applied voltage $V_{MBN}$ and the displacement of (up/down) membrane position can be expressed as $\Delta P_Z \propto d_{31} \cdot \Delta V$. Note that, piezoelectric actuator is mainly described in the above. The membrane 103 is not limited to be piezoelectric actuated. For example, the actuator 105 may also be a nanoscopic electrostatic drive (NED) actuator, which is also within the scope of the present application.

Notably, if the applied signal (e.g., $V_{MBN}$) contains significant frequency component near the resonance frequency, due to the ringing introduced by the high Q of SPD, Eq. 1 can no longer precisely predict the position of the membrane. In contrast, if the driving signal $V_{MBN}$ applied to piezoelectric actuator contains negligible amount of energy near the resonance frequency of the MEMS SPD 10 (or an energy of the driving signal $V_{MBN}$ at the resonance frequency $f_R$ is less than a specific threshold ε, i.e., $E(V_{MBN}, f=f_R)<\varepsilon$, where $E(V_{MBN}, f=f_R)$ represent the energy of the driving signal $V_{MBN}$ at the resonance frequency $f_R$), which can be achieved by $f_R>f_{max}+\Delta f/2$, then the position of the membrane 103 can be predicted rather precisely by eq. 1. Thus, the PAM SPD may be made to behave like a voltage-controlled-position device when the driving signal $V_{MBN}$ contains negligible frequency components near the resonance frequency $f_R$, due to $f_R>f_{max}$ Δf/2, where the voltage-controlled-position device represents that the position Pz is controllable/predictable and controlled by the driving signal $V_{MBN}$ or even by the input audio signal AUD.

Practically, the piezoelectric actuator's transverse deformation coefficient $d_{31}$ may be voltage dependent, instead of being constant. In addition, the displacement $\Delta P_Z$ may be affected by the stress experience by membrane which may itself be a function of the displacement $\Delta P_Z$. Taking these factors into consideration, eq. 1 may be modified as $\Delta P_Z \propto g(V) \cdot \Delta V$ (eq. 1'), here g(V) denotes a voltage dependent function, which is usually nonlinear. To achieve a linearity between the input/source audio signal and the membrane displacement, a compensating circuit may be incorporated.

Figure 3:
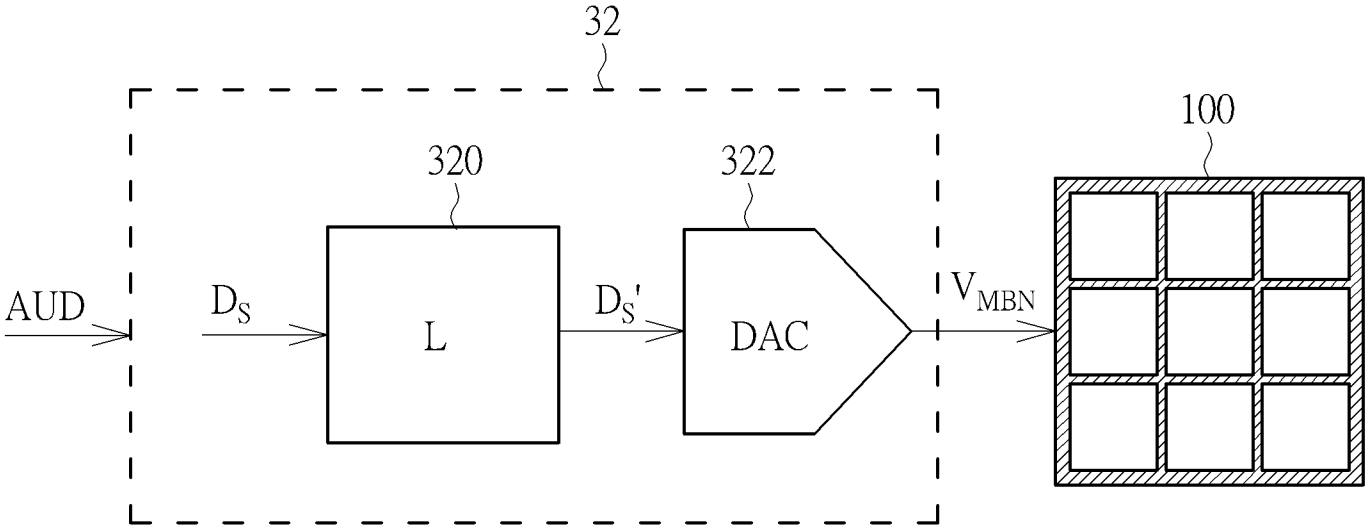
FIG. 3 is a schematic diagram of a driving circuit according to an embodiment of the present application.

FIG. 3 is a schematic diagram of a driving circuit 32 according to an embodiment of the present application. The driving circuit 32 may be used to realize the driving circuit 12. The driving circuit 32 may comprise a compensating circuit 320 and a digital-to-analog converter (DAC) 322. The compensating circuit 320 operates, for example, in a digital domain. The compensating circuit 320 may receive an input/source data Ds and output a compensated data Ds'. The input/source data Ds can be viewed as a digital (or processed) version of the input audio signal AUD. The DAC 322 converts the compensated data Ds' so that the driving circuit 32 outputs the driving signal $V_{MBN}$, ignoring power amplifier. The data Ds and Ds' may have a relationship of a compensating function L, where Ds'=L(Ds), which means that the compensating circuit 320 is corresponding to the compensating function L.

Figure 4:
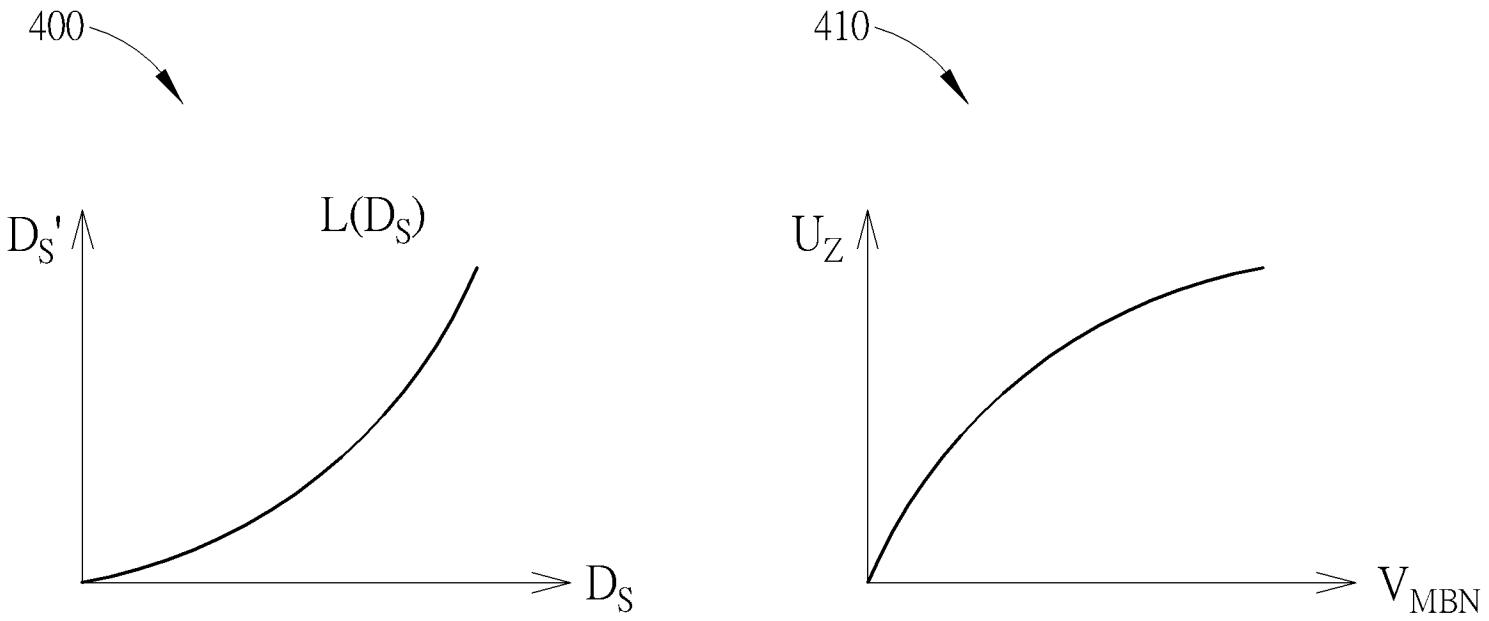
FIG. 4 illustrates a curve representing a compensating function according to an embodiment of the present application.

FIG. 4 illustrates the compensating function L. In FIG. 4, a curve 410 representing the membrane displacement Uz versus the driving signal $V_{MBN}$ and a curve 400 representing the compensated data Ds' versus the input data Ds are illustrated. The membrane displacement Uz is the position difference ΔPz, i.e., Uz=ΔPz. The nonlinear curve 410 can be obtained by testing and measuring the device (or SPD), where the nonlinearity is resulted from the device characteristic which may be related to g(V) or the stress of the specific membrane design. Once the nonlinear curve 410 is obtained, the curve 400 illustrating the compensating function L can be derived. The compensating function L shall be an inverse function of a function represented by the curve 410. In an embodiment, supposed the function represented by the curve 410 is proportional to g(V), the compensating function L may satisfy g(L(V))=c, where c represents some constant.

By including the compensating circuit 320, the membrane displacement Uz would be proportional the input/source data Ds, i.e., Uz∝Ds. It is equivalent to Uz∝AUD, ignoring the quantization error induced by analog-to-digital converter (ADC) and DAC.

Figure 5:
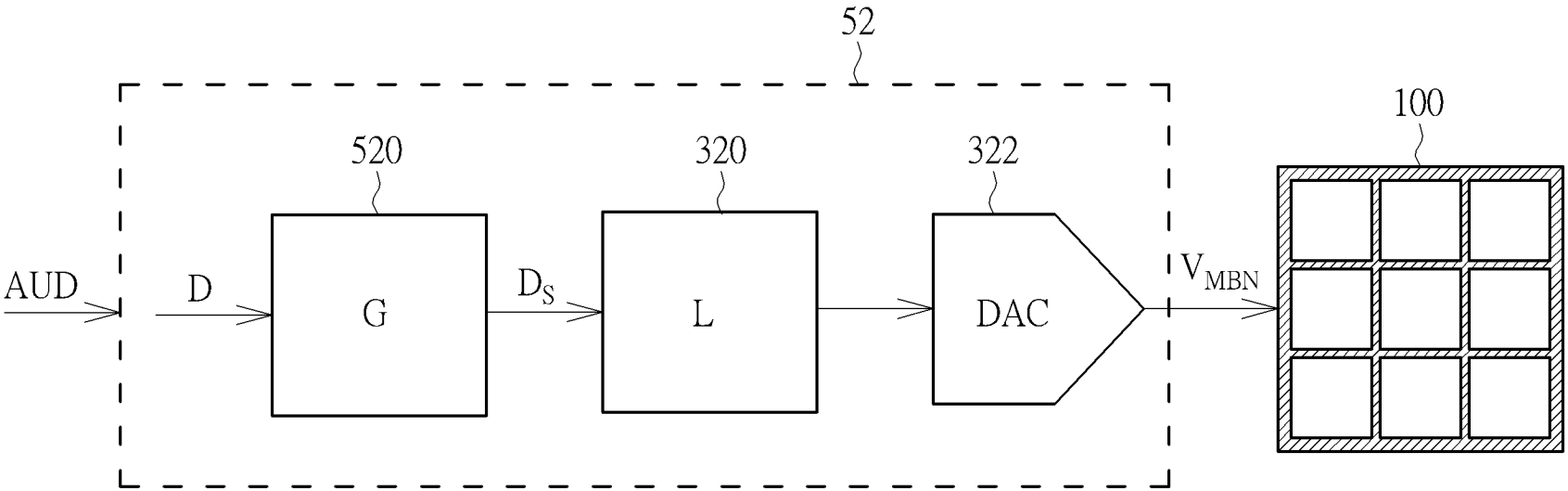
FIG. 5 is a schematic diagram of a driving circuit according to an embodiment of the present application.

FIG. 5 is a schematic diagram of a driving circuit 52 according to an embodiment of the present application. The driving circuit 52 may be used to realize the driving circuit 12. The driving circuit 52 is similar to the driving circuit 32, and thus, same components are denoted by the same notations. Different from the driving circuit 32, the driving circuit 52 further comprises a conversion circuit 520. The conversion circuit 520 is corresponding to a function G.

Figure 6:
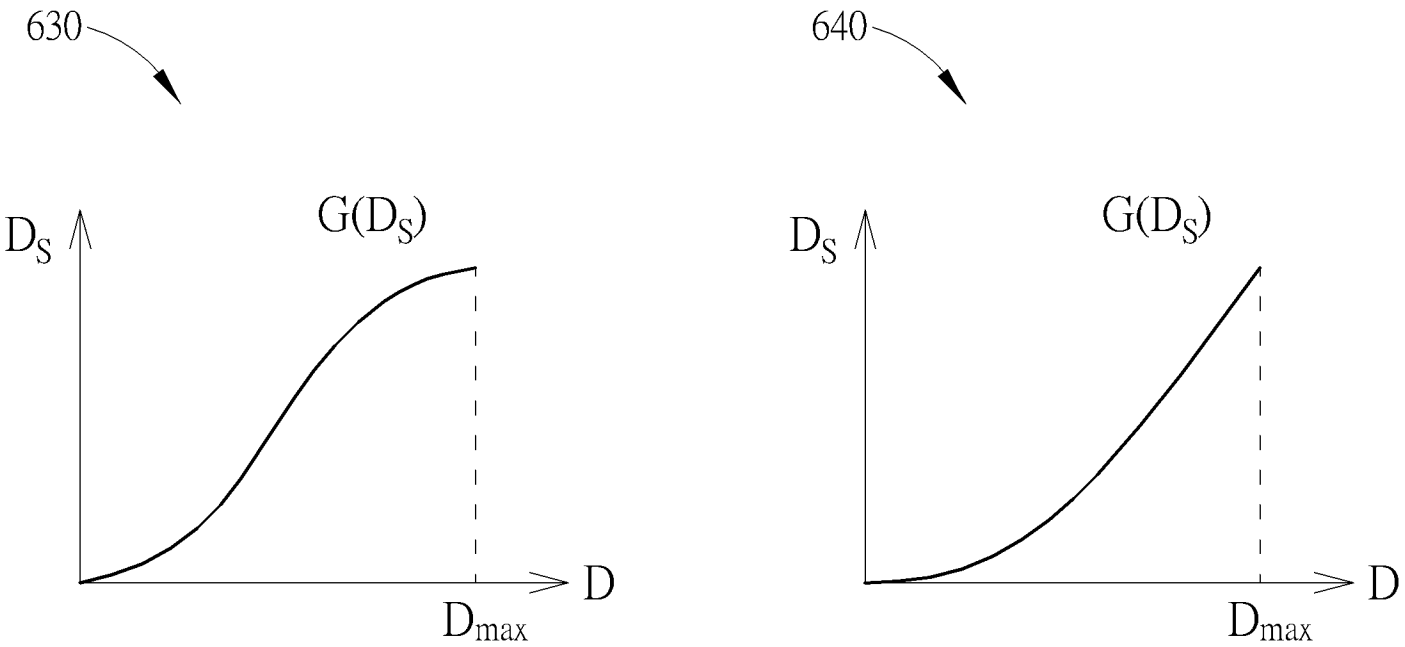
FIG. 6 illustrates a curve corresponding to a conversion circuit according to an embodiment of the present application.

In an embodiment, the conversion circuit 520, in addition to the compensating circuit 320, may be configured to perform a soft clipping operation. An illustrative curve 630 of the function G for soft clipping is illustrated in FIG. 6. From the curve 630, a slope at the mid-section of the curve 630 is steeper than the ones at the two ends near $D_S=0$ and $D_S=D_{S,\,max}$. The net effect of the curve 630 representing the function G and the curve 400 representing the function L is that, the SPL (sound pressure level) corresponding to the signal with small $D_S$ amplitude would be increased while the behavior near saturation is precisely controlled and the disturbing clipping sound is minimized when the $D_S$ amplitude starts to approach the maximum $D_{S,\,max}$.

In an embodiment, another illustrative curve 640 of the function G is also illustrated in FIG. 6. A slope of the curve 640 is close to 0 near $D_S=0$ and increases at a rate of approximately $D_S^2$. The net effect of the curve 640 representing the function G and the curve 400 representing the function L is to imitate the sound signatures of vacuum tube amplifiers.

In summary, the present application utilizes the membrane with high Q and the resonance frequency significantly higher than the maximum frequency of the input/source audio signal, such that the SPD may be the voltage-controlled-position device Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sound producing device (SPD), comprising:

a membrane, having a resonance frequency and a resonance bandwidth; and an actuator, disposed on the membrane, receiving a driving signal corresponding to an input audio signal;

wherein the input audio signal and the driving signal have has an input audio band which is upper bounded by a maximum frequency;

wherein the resonance frequency is higher than the maximum frequency plus a half of the resonance bandwidth;

wherein the SPD operates in the input audio band lower than the resonance frequency.

2. The SPD of claim 1, wherein the resonance frequency is higher than the maximum frequency plus a multiple of the resonance bandwidth.

3. The SPD of claim 1, wherein the resonance frequency is at least 10% higher than the maximum frequency.

4. The SPD of claim 1, wherein a quality factor of the membrane is at least 50.

5. The SPD of claim 1, wherein the actuator is a piezoelectric actuator.

6. The SPD of claim 1, wherein the actuator is a nanoscopic electrostatic drive actuator.

7. The SPD of claim 1, wherein the actuator is coupled to a driving circuit, and the driving circuit comprises a compensating circuit, such that a displacement of the membrane is proportional to an input signal of the compensating circuit.

8. The SPD of claim 7, wherein the compensating circuit is corresponding to a compensating function, the compensating function is an inverse function of a first function, the first function is a function of a membrane displacement versus the driving signal.

9. The SPD of claim 8, wherein the first function is obtained by testing and measuring the SPD.

10. The SPD of claim 1, wherein when the SPD operates at a frequency lower than the resonance frequency minus the half of the resonance bandwidth, a position of the membrane is controlled by the driving signal, and a position difference of the membrane is proportional to a voltage difference of the driving signal.

11. The SPD of claim 1, wherein when an energy of the driving signal at the resonance frequency is less than a specific threshold, a position of the membrane is controlled by the driving signal and predictable according to the driving signal.

* * * * *